US008864981B2

(12) United States Patent
Chang et al.

(10) Patent No.: US 8,864,981 B2
(45) Date of Patent: Oct. 21, 2014

(54) FEED MIXTURES FOR EXTRACTION PROCESS TO PRODUCE RUBBER PROCESSING OIL

(75) Inventors: Chih-Cheng Chang, Chia-Yi (TW); Jung-Huang Wu, Kaohsiung (TW); Cheng-Tsung Hong, Tainan (TW); Jin-Shang Liou, Chia-Yi (TW); Kuo-Min Wei, Chia-Yi (TW); Hung-Chung Shen, Chia-Yi (TW); Fu-Ming Lee, Katy, TX (US)

(73) Assignee: CPC Corporation, Taiwan, Taipei (TW)

( * ) Notice: Subject to any disclaimer, the term of this patent is extended or adjusted under 35 U.S.C. 154(b) by 660 days.

(21) Appl. No.: 13/007,581

(22) Filed: Jan. 14, 2011

(65) Prior Publication Data

US 2012/0181220 A1 Jul. 19, 2012

(51) Int. Cl.

| | |
|---|---|
| ***C10G 17/04*** | (2006.01) |
| ***C10G 53/00*** | (2006.01) |
| ***C10G 21/00*** | (2006.01) |
| ***C10G 21/27*** | (2006.01) |
| ***C10G 21/22*** | (2006.01) |
| ***C10G 21/16*** | (2006.01) |
| ***C10G 21/20*** | (2006.01) |

(52) U.S. Cl.

CPC ..... *C10G 21/16* (2013.01); *C10G 53/00* (2013.01); *C10G 2300/302* (2013.01); *C10G 2300/1062* (2013.01); *C10G 21/003* (2013.01); *C10G 2400/30* (2013.01); *C10G 2300/44* (2013.01); *C10G 21/27* (2013.01); *C10G 21/22* (2013.01); *C10G 2300/1074* (2013.01); *C10G 21/20* (2013.01); *C10G 2300/30* (2013.01)

USPC ..... 208/312; 208/19; 208/311; 208/317; 208/320; 208/327; 585/1; 585/13; 585/319

(58) Field of Classification Search

CPC ..... C10G 21/00; C10G 21/06; C10G 21/28

USPC ..... 208/312, 19, 311, 317, 320, 327; 585/1, 585/13, 319

See application file for complete search history.

(56) References Cited

U.S. PATENT DOCUMENTS 2,178,321 A * 10/1939 Clarke ..... 208/323
2,851,395 A * 9/1958 Kiersted, Jr. et al. ..... 208/318

(Continued)

FOREIGN PATENT DOCUMENTS

| | | |
|---|---|---|
| EP | 0417980 A1 | 3/1991 |
| EP | 0417980 B1 | 6/1997 |
| SG | 174123 A1 | 10/2011 |

*Primary Examiner* — Michelle Stein

(74) *Attorney, Agent, or Firm* — Cascio & Zervas

(57) ABSTRACT

Deasphalted residual oil (DAO) and the aromatics-rich extract that is derived from DAO have low polycyclic aromatics contents, relatively low aniline points, and high flash points. They form blending stocks that improve properties of mixed feedstocks to consistently produce environmentally qualified rubber processing oil (RPO) by extraction under low solvent-to-oil ratios and moderate extraction temperatures. Distilling a petroleum crude oil under atmospheric pressure generates a bottom residual oil which is then subject to vacuum distillation to yield a bottom residual oil. DAO is produced by removing the asphalt from the vacuum bottom residual oil through extraction with light paraffinic solvent. The extract of DAO is a co-product in the production of the bright stock of the lubricating oil through extraction. The feedstock is mixed with the extract from a petroleum fraction boiling in lube oil range. Liquid-liquid counter-current extraction yields a raffinate stream; removal of solvent therefrom produces the RPO.

11 Claims, 4 Drawing Sheets

(56) References Cited

U.S. PATENT DOCUMENTS

| | | | | | |
|---|---|---|---|---|---|
| 2,868,716 | A | * | 1/1959 | Moyer | 208/87 |
| 3,723,295 | A | * | 3/1973 | Kress | 208/87 |
| 3,912,618 | A | * | 10/1975 | Dryer | 208/87 |
| 3,968,023 | A | * | 7/1976 | Yan | 208/86 |
| 5,135,640 | A | * | 8/1992 | Vizner | 208/92 |
| 5,846,405 | A | | 12/1998 | Aldous et al. | |
| 6,146,520 | A | | 11/2000 | Gupte et al. | |
| 6,248,929 | B1 | | 6/2001 | Kaimai et al. | |
| 6,878,263 | B2 | | 4/2005 | Kaimai et al. | |
| 7,186,876 | B2 | | 3/2007 | Manton et al. | |
| 7,686,945 | B2 | | 3/2010 | Benard et al. | |
| 2001/0045377 | A1 | | 11/2001 | Morishima et al. | |
| 2005/0272850 | A1 | | 12/2005 | Jois et al. | |
| 2009/0020453 | A1 | * | 1/2009 | Tanaka et al. | 208/23 |

* cited by examiner

FEED MIXTURES FOR EXTRACTION PROCESS TO PRODUCE RUBBER PROCESSING OIL

FIELD OF THE INVENTION

The present invention is generally directed to methods of producing rubber processing oil (RPO) with low polycyclic aromatics content and, in particular, to techniques whereby deasphalted residual oil (DAO) and aromatics-rich extracts from DAO are used as blending stock to improved the properties of mixed feedstocks that are used to produce environmentally qualified RPO on a consistent basis.

BACKGROUND OF THE INVENTION

Rubber processing oils are used as plasticizers or extenders in the production of rubber. RPO is normally co-produced in the lube oil refining process, including the extraction process. In the extraction process, the raffinate phase is refined to produce the base stock for lube oil blending while the extract phase is further processed to produce the RPO. Conventional techniques produce RPO with polycyclic aromatics (PCA) content of 5 wt % or higher. While the European Union has mandated that the PCA content in RPO (as measured by Method IP346) to be less than 3 wt %, the RPO must still be rich in aromatics in order soften rubber components during processing. In particular, the environmentally approved RPO must exhibit a total aromatics (TA) content of more than 50 wt %, a PCA of less than 3 wt %, an aniline point that is lower than 80° C., a kinematic viscosity from 15 to 30 $mm^2/s$ at 100° C., and a flash point that is higher than 250° C.

Maintaining RPO quality while reducing its PCA content to comply with the new environmental regulations has been the goal of intense research. Techniques to reduce the PCA such as by selecting suitable feedstocks for blending or employing additional processing to produce acceptable RPO are described, for example, in U.S. Pat. No. 7,186,876 to Manton et al., EP 0 417 980 A1 to Glenz, U.S. Pat. No. 5,846,405 to Aldous et al., U.S. Pat. application. No. 2005/0272850 to Jois et al, U.S. Pat. No. 6,878,263 to Kaimai et al., U.S. Pat. application. No. 2009/0020453 to Tanaka et al., and U.S. Pat. application. No. 2001/0045377 to Morishima et al. These techniques are not completely satisfactory because the RPOs produced have high PCA contents and/or high aniline points or the processes require stringent operating conditions and/or complex, expensive equipment.

SUMMARY OF THE INVENTION

The present invention is based in part on the recognition that, although DAO alone is not a reliable feedstock to produce acceptable RPO, DAO and the aromatics-rich extract that is derived from DAO have low PCA contents, relatively low aniline points, and high flash points as compared to other sources of feedstock. These attributes make them suitable blending stocks to improve the properties of mixed feedstocks that consistently produce environmentally qualified RPO through an extraction process operating under low solvent-to-oil ratios and moderate extraction temperatures.

The DAO as a blending feedstock is preferably prepared by initially distilling a petroleum crude oil under atmospheric pressure to generate a bottom residual oil, which then undergoes vacuum distillation to yield a bottom residual oil. DAO is subsequently produced by removing the asphalt from the vacuum bottom residual oil through extraction with propane or other light paraffin solvent to reduce the carbon residue to less than 2 wt %. The extract of the DAO extraction, the other blending feedstock, is preferably generated as a co-product in the production of the bright stock of lubricating oil.

Either the DAO or the extract of the DAO is mixed with the extract from a petroleum fraction boiling in lube oil range, which is, preferably, co-produced in the production of the lube base oil. The mixed feedstock is then fed to a lower portion of a liquid-liquid extractor column to counter-currently contact an extractive solvent, which is introduced into an upper portion of the extractor. A raffinate stream, that is withdrawn from the top of the extractor, is stripped to remove the solvent to produce the environmentally qualified RPO product having the following properties: (1) PCA of less than 3 wt % (method IP346), (2) total aromatics (TA) of more than 50 wt % (method IP391) or aromatic carbons (% $C_A$) of more than 20 wt % (method D2140), (3) aniline point that is lower than 80° C. (method D611), (4) kinematic viscosity from 15 to 30 $mm^2/s$ at 100° C. (by method D445), and (5) flash point that is higher than 250° C. (method D92).

In one aspect, the invention is directed to a process for preparing an environmentally safe RPO having the above attributes, which includes the steps of:

(a) producing a first aromatics-rich extract, from a petroleum fraction boiling in the lube oil range, through solvent extraction with a first polar extractive solvent;

(b) producing a second aromatics-rich extract, from a deasphalted residual oil that is derived from vacuum distillation, through solvent extraction with a second polar extractive solvent;

(c) mixing the first aromatics-rich extract and the second aromatics-rich extract to yield a mixture that is subject to solvent extraction with a third polar extractive solvent to yield a raffinate phase; and (d) removing the third polar extractive solvent from the raffinate phase to yield the RPO.

In another aspect, the invention is directed to a process for preparing RPO which includes the steps of:

(a) producing an aromatics-rich extract, from a petroleum fraction boiling in the lube oil range, through solvent extraction with a first polar extractive solvent;

(b) mixing the aromatics-rich extract with a deasphalted residual oil from vacuum distillation to form a mixture that is subject to solvent extraction with a second polar extractive solvent to form a raffinate phase; and (c) removing the second polar extractive solvent from the raffinate phase to yield the RPO.

In yet a further aspect, the invention is directed to a process for preparing RPO which includes the steps of:

(a) producing an aromatics-rich extract, from a petroleum fraction boiling in the lube oil range, through solvent extraction with a first polar extractive solvent;

(b) subjecting the aromatics-rich extract to solvent extraction with a second polar extractive solvent to yield a first raffinate;

(c) removing the second polar extractive solvent from the first raffinate to yield a second raffinate; and (d) mixing the second raffinate with deasphalted residual oil to produce the RPO. In each process, the solvents can be the same and comprise, for example, furfural.

DETAILED DESCRIPTION OF THE PREFERRED EMBODIMENTS

Figure 1:
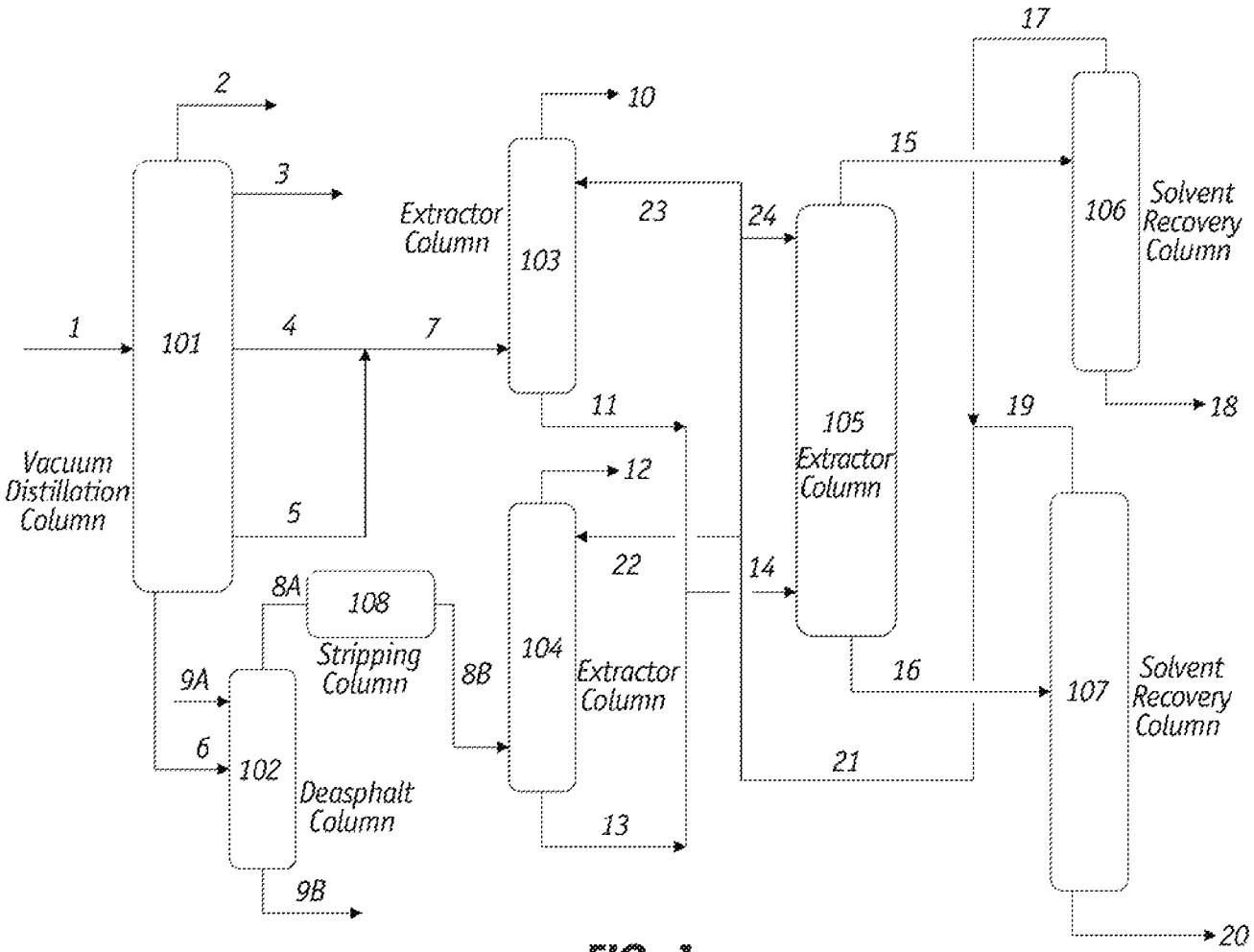
FIG. 1 is a schematic flow diagram of a method for producing RPO by extracting feed mixtures containing the extract of DAO and the extract of vacuum distillate oils.

The invention provides novel feedstock mixtures that are used to produce RPO that complies with recently enacted environmental guidelines. The RPO is produced continuously with the feedstock mixtures or, in the alternative, the feedstock mixtures are processed sequentially in a so-called "blocked out" operation using existing extraction process equipment to minimize capital and operating costs.

The viability of using DAO and aromatics-rich extracts derived from DAO as feedstock sources to produce RPO is supported by an analysis of related experimental data disclosed in the prior art. For example, U.S. Pat. No. 6,248,929 to Kaimai et al, in columns 11 and 12, describes distilling Arabian light crude oil under reduced pressures and thereafter subjecting the residues to propane deasphalting. Reported properties of the DAO are presented in Table 1:

TABLE 1

| DAO Property | A | B | C |
|---|---|---|---|
| PCA (by method IP346), wt % | 1.3 | 1.15 | 1.00 |
| Aniline Point (° C.) | 109 | 110 | 110 |
| KV (40° C.), $mm^2/s$ | 700 | 640 | 630 |
| TAN, mg KOH/g | | 0 | |

Note:
DAO A, B, and C are the vacuum residual oils from Arabian Light Crude deasphalted by propane extraction under various conditions.

As is evident, the DAO PCA content is quite low (from 1 to 1.3 wt %) and the aniline point is relatively low at 110° C. In addition, the '929 patent reports that the DAO and a comparative distillate fraction, boiling in the lube base oil range (340 to 650° C.) that was derived from the same vacuum distillation of the Arabian light crude were subject to furfural extraction. Table 2 summarizes the physical data for the extracts derived from both feedstocks as reported in Comparative Examples 1-1 and 1-2 of the '929 patent.

TABLE 2

| Feedstock | PCA (wt %) | Aniline point (° C.) | $C_A$ (wt %) | Viscosity ($mm^2/s$ @ 40° C.) |
|---|---|---|---|---|
| DAO | 5.1 | 60 | 35 | 5740 |
| Distillate | 23 | 43 | 48 | 2360 |

As is apparent, the extract from the DAO contains significantly less PCA than the extract from the distillate boiling in the lube base oil range. The present invention recognizes that, with respect to PCA content and aniline point, the extract from the DAO is comparable to or even better than DAO by itself as a blending stock in the production of RPO through an extraction process. Finally, as a result of the high boiling ranges of the DAO and of the extract from DAO, the flash point of the RPO produced from these feed mixtures will also increase.

With the present invention, the DAO as one of the blending stocks of the feed mixtures for producing RPO is preferably prepared by first distilling a petroleum crude oil under atmospheric pressure to generate a bottom residual oil which is then subject to vacuum distillation to obtain a second bottom residual oil. Thereafter, the DAO is generated by removing the asphalt content in the vacuum bottom residual oil through extraction with propane or other light paraffin solvents to reduce the carbon residue to less than 2 wt %.

The extract of DAO, which is the other blending stock, is preferably generated as a co-product in production of the bright stock of the lubricating oil, by contacting the DAO with an extractive solvent in a liquid-liquid extractor under relatively mild conditions.

In a preferred process of producing the RPO, the extract of DAO is mixed with an extract of petroleum fraction boiling in the lube base oil range, which is co-produced in the production of the lube base oil. The mixed feedstock is then fed to lower portion of a liquid-liquid extractor to counter-currently contact with an extractive solvent, which is introduced into the upper portion of the extractor. A raffinate stream is withdrawn from the top of the extractor, which is stripped of solvent to produce the RPO product, while extract stream is removed from the bottom of the extractor for further processing.

In another preferred process for producing the RPO, the DAO is mixed with an extract of a petroleum fraction boiling in the lube base oil range. The mixed feedstock is extracted counter-currently with an extractive solvent in an extractor. The RPO product is yielded from the raffinate stream that is withdrawn from the top of the extractor after the solvent content is removed.

In a third preferred process for producing the RPO, an extract of a petroleum fraction boiling in the lube oil range is extracted counter-currently in an extractor. The raffinate stream that is withdrawn from the top of the extractor is stripped of solvent and then mixed with appropriate amounts of DAO to produce the RPO product.

A method of producing RPO by extracting feed mixtures containing the extract of DAO and the extract of vacuum distillate oils is shown in FIG. 1. This process begins when the bottom from an atmospheric crude oil distillation column is introduced via line 1 into a middle portion vacuum distillation column 101 which yields light distillate oil, a medium distillate oil, and a heavy distillate oil that are removed from side-cut streams 3, 4, and 5, respectively. The medium and heavy distillate oils are preferably mixed to create a suitable distillate mixture, which boils in the lube base oil range that is preferably in the range of 390-620° C., and which is fed to the lower portion of extractor column 103 via line 7. An extractive solvent enters the upper portion of extractor column 103 via line 23 and contacts the feed mixture counter-currently. The column top temperature is maintained at 80-130° C. and preferably at 90-120° C. whereas the column bottom temperature is maintained at 60-100° C. and preferably at 70-90° C. The solvent-to-oil (petroleum fraction) ratio range is typically 0.5-3.0 and preferably 1.0-2.0. A raffinate stream is withdrawn from the top of extractor 103 via line 10 while an extract stream is taken from the bottom of extractor 103 through line 11. Raffinate stream 10 is further processed to remove solvent that is recycled to the extractors and to yield lube base oil.

Lights or tail gas 2 are removed from the top of vacuum distillation column 101 for proper disposal and a vacuum residue with a boiling range of 500-900° C. is fed from the bottom of column 101 through line 6 into a deasphalt column 102. The vacuum residue is extracted with propane or other light paraffinic solvent, which is fed into column 102 through line 9A, to remove the asphalt and thereby produce deasphalted oil (DAO) that has less than 2 wt % carbon residue. The asphalt-rich raffinate stream is removed via line 9B. The DAO is withdrawn via line 8A as the extract from the top of column 102 and transferred to a stripping column 108 where the DAO and deasphalting solvent are separated.

The treated DAO is fed through line 8B into extractor column 104 where an extractive solvent enters the upper portion of extractor column 104 via line 22 to contact the feed mixture counter-currently. The column top temperature is maintained within a range of 90-150° C. and preferably from 100-140° C. whereas the column bottom temperature is maintained within a range of 70-130° C. and preferably from 80-110° C. The solvent-to-oil (DAO) ratio within column 104 is 1.0-5.0 and preferably 2.0-4.0. The extract yield ranges from 20 to 50%. A raffinate stream 12 is withdrawn from the top of extractor 104 and after solvent is removed from the raffinate and recycled to the extractors, a bright stock for lubricating oil is produced. In the meantime, an extract stream 13 is taken from the bottom of extractor 104.

The extract stream in line 11 (the extract of the vacuum distillate) is mixed with the extract stream in line 13 (the extract of the DAO) at a volume ratio of from 90:10 to 50:50 and preferably from 80:20 to 60:40. The mixed extract 14 is fed to a lower portion of extractor column 105 where the feed is subject to counter-current extraction with an extractive solvent 24 that is introduced into an upper portion of the column. The top temperature of extractor 105 is maintained at a range from 40-100° C. and preferably from 60-90° C. whereas the bottom temperature of the extractor is maintained at a range of 30-70° C. and preferably 40-60° C. The solvent-to-oil volume ratio for the extraction is in the range of 1.0-5.0 and preferably 1.0-3.0.

A raffinate stream 15 is withdrawn from the top of extractor 105 and transferred to a solvent recovery column (SRC) 106 where solvent is stripped from the raffinate. Recovered solvent 17 from the top of SRC 106 is recycled to extractor columns 103, 104 and 105 via lines 21, 22, 23, and 24. The rubber processing oil product 18 that is recovered from the bottom of SRC 106 meets or exceeds the new environmental standards with respect to PCA, aniline point, kinematic viscosity, total aromatics (TA), flash point, and other properties for RPO. An extract stream 16 is withdrawn from the bottom of extractor 105 and transferred to SRC 107 where the solvent is stripped off. Recovered solvent 19 is recycled to extractors 103, 104, and 105 via lines 21, 22, 23, and 24, while a solvent-free extract 20 is recovered from the bottom of SRC 107.

Since the operating conditions for extractor columns 103 and 105 are similar, the continuous process illustrated in FIG. 1 can be modified to operate in a blocked out operation whereby extractor column 105 is effectively eliminated. Specifically, while operating under normal conditions, the extracts 11, 13 formed in extractor columns 103, 104, respectively, are mixed and collected rather than being introduced into an extractor column 105, which has been eliminated. Thereafter, in blocked out operation, the normal flows into extractors 103, 104 are stopped. In the meantime, the mixed extract is fed from storage through the lower part of extractor 103 while an extractor solvent is fed into an upper part in order to achieve counter-current extraction to form a raffinate that is transferred to SRC 106 where the RPO is produced upon removal of solvent. In the sequential blocked out operation, extractor 103 operates under conditions necessary to yield a raffinate stream from which the RPO is produced, that is, it operates under the same conditions of extractor 105 in the continuous process.

The polar extractive solvent for the process can include, for example, furfural, N-methyl pyrrolidone (NMP), dimethyl sulfoxide (DMSO), propylene carbonate, and mixtures thereof. The preferred solvent is furfural. Suitable extractors for the invention, include, for example, columns with trays, columns with packings, columns with rotating discs, and pulse columns.

Figure 2:
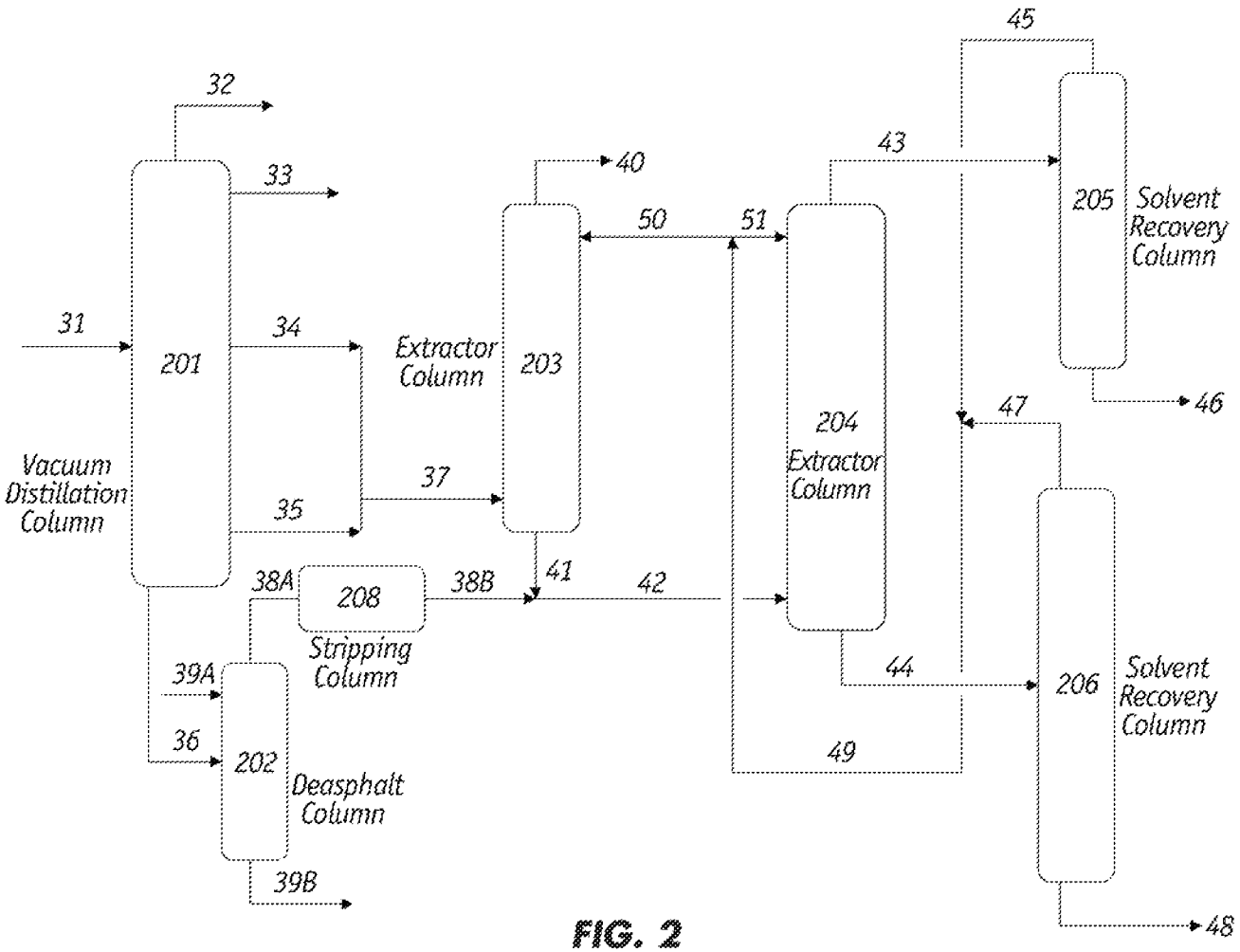
FIG. 2 is a schematic flow diagram of a method for producing RPO by extracting feed mixtures containing the DAO and the extract of vacuum distillate oils.

A method of producing RPO by extracting feed mixtures containing the DAO and the extract of vacuum distillate oils is shown in FIG. 2. In the initial phase of this process, vacuum distillation column 201 and extractor columns 202 and 203 operate under the same conditions as those of vacuum distillation column 101 and extractor columns 102 and 103 in the process illustrated in FIG. 1. In particular, feed 31 from the bottom from an atmospheric crude oil distillation column is introduced into a middle portion vacuum distillation column 201 that yields a light distillate oil 33, a medium distillate oil 34, and a heavy distillate oil 35. The medium and heavy distillate oils form a distillate mixture 37 that is fed to a lower portion of extractor column 203 while an extractive solvent 50 is fed through an upper portion. A raffinate stream 40 is withdrawn from the top of extractor 203 while an extract stream 41 is removed from the bottom.

Lights or tail gas 32 are removed from the top vacuum distillation column 201 while vacuum distillation residue 36 is fed from the bottom into a deasphalt column 202. The vacuum residue is extracted with propane or other light paraffinic solvent, which is fed into column 202 through line 39A, to remove the asphalt and thereby produce deasphalted oil (DAO). The asphalt-rich raffinate stream is removed through line 39B. The DAO is withdrawn via line 38A as the extract from the top of column 202 and transferred to a stripping column 208 for solvent removal.

The DAO recovered via line 38B from stripping column 208 is mixed with the extract 41, of the lube range distillate from the bottom of extractor 203, at a volume ratio of from 10:90 to 50:50 and preferably from 20:80 to 40:60. The mixed extract 42 is fed to a lower portion of extractor column 204 and contacts counter-currently an extractive solvent 51, which is introduced through an upper portion. The operating conditions of extractor 204 can be the same as those of extractor column 105 of FIG. 1.

A raffinate stream 43 from the top of extractor 204 is stripped of solvent in solvent recovery column (SRC) 205 to yield rubber processing oil 46. Recovered solvent 45 from the top of SRC 205 is recycled via lines 49, 50, and 51. Similarly, an extract stream 44 from the bottom of extractor 204 is stripped of solvent in SRC 206. Recovered solvent 47 from the top of the column is recycled via lines 49, 50 and 51 while a solvent-free extract 48 is recovered from the bottom.

Since the operating conditions for extractor columns 203 and 204 are similar, the continuous process illustrated in FIG. 2 can be modified to proceed sequentially in a blocked out operation whereby extractor column 204 is eliminated. Specifically, while operating under normal conditions, the extract 41 is collected. Thereafter, in blocked out operation, the normal flow into extractor 203 is interrupted, and, extract 41 from storage is mixed with the DAO and fed through the lower part of extractor 203 while an extractor solvent is fed into an upper part in order to achieve counter-current extraction to form a raffinate that is transferred to SRC 205 where the RPO is produced upon removal of solvent. In the blocked out operation, the parameters of column 203 are the same as those of column 204.

Figure 3:
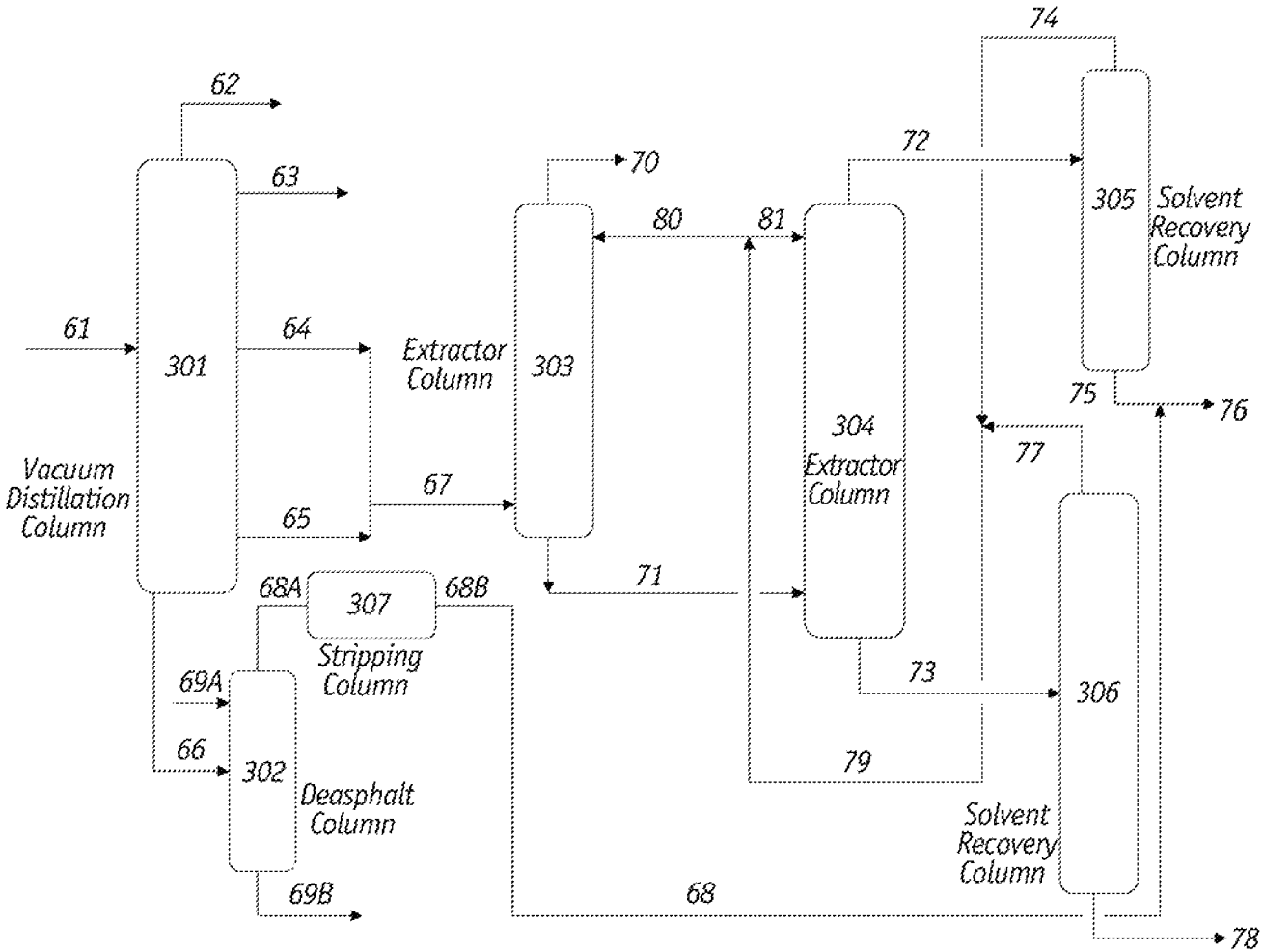
FIG. 3 is a schematic flow diagram of a method for producing RPO by mixing the DAO with the raffinate from an extraction of the extract of vacuum distillate oils.

Finally, a method of producing RPO by mixing the DAO with the raffinate from an extraction of the extract of vacuum distillate oils is illustrated in FIG. 3. In the initial phase of this process, vacuum distillation column 301 and extractor columns 302 and 303 also operate under the same conditions as vacuum distillation column 101 and extractor columns 102 and 103 in the process illustrated in FIG. 1. Thus, feed 61 from the bottom from an atmospheric crude oil distillation column is introduced into the middle portion vacuum distillation column 301 that yields a light distillate oil 63, a medium distillate oil 64, and a heavy distillate oil 65. The medium and heavy distillate oils form a distillate mixture 67 that is fed to the lower portion of extractor column 303 while an extractive solvent 80 is fed through an upper portion. A raffinate stream 70 is withdrawn from the top of extractor 303 while an extract stream 71 is removed from the bottom.

Lights or tail gas 62 are removed from the top vacuum distillation column 301 while vacuum distillation residue 66 is fed from the bottom into a deasphalt column 302. The vacuum residue is extracted with propane or other light paraffinic solvent, which is fed into column 302 through line 69A, to remove the asphalt and thereby produce a deasphalted oil (DAO) and solvent stream which is withdrawn via line 68A as the extract from the top of column 302 and transferred to a stripping column 307 where the deasphalting solvent is removed. The asphalt-rich raffinate is removed from column 302 through line 69B.

The extract of vacuum distillate oils from the bottom of extractor column 303 is fed via line 71 to a lower portion of extractor column 304 where it is counter-currently extracted by a solvent 81, which is introduced to the upper portion of extractor 304. A raffinate stream 72 is withdrawn from the top of extractor 304 and fed to SRC 305 where solvent 74 is removed. A solvent-free raffinate 75, which is recovered from the bottom of SRC 305, is mixed with the DAO from line 6813 within restricted mixing ratios to produce a rubber producing oil 76. The mixing ratio of the solvent-free raffinate 75 to the DAO 68 is preferably controlled by the aniline point of the blended RPO product. If a lower aniline point for the RPO is desired, then a higher percentage of solvent-free raffinate 75 should be used. An extract stream 73 from the bottom of extractor 304 is stripped of solvent in SRC 306. Recovered solvent 74, 77 from columns 305, 306 is recycled through lines 79, 80, and 81 while a solvent-free extract 78 is recovered from the bottom. To produce qualified RPO with the desired properties, the operating parameters of extractor 304 can be regulated by measuring selected properties of raffinate 72 and establishing appropriate feedback control.

Again, since the operating conditions for extractor columns 303 and 304 are similar, the continuous process illustrated in FIG. 3 can be proceed sequentially in a blocked out operation whereby extractor column 304 is eliminated. Specifically, while operating under normal conditions, extract 71 and DAO 68 are separately collected. Thereafter, in the blocked operation, the normal flow into extractor 303 is stopped; instead, extract 71 is fed from storage through the lower part of extractor 303 while an extractor solvent is fed into an upper part in order to achieve counter-current extraction to form a raffinate that is transferred to SRC 305 where a solvent-free raffinate 75 is formed. DAO 68 from storage is mixed with raffinate 75 to yield the desired RPO. In blocked out operation, extractor 303 operates under the same parameters as extractor 304.

EXAMPLES

The following examples are presented to further illustrate the preferred embodiments of this invention and are not to be considered as limiting the scope of this invention.

Example 1

In the process illustrated in FIG. 1, extract from medium and heavy distillate oils in line 11 is mixed with extract from DAO in line 13 to form an extract mixture that is fed into the extractor column 105. In this example, a representative extract of the blend of medium and heavy distillate was mixed with an extract from DAO at a volume ratio of approximately 70:30 to generate a feed mixture having a boiling range from 350 to 695° C. Selected properties of the mixed extract were measured as summarized in Table 3:

TABLE 3

| Property | Value | Test Method |
|---|---|---|
| Kinematic Viscosity @ 100° C. ($mm^2/s$) | 26.1 | ASTM D445 |
| PCA (wt %) | 15.3 | IP-346 |
| HPLC Composition Analysis (wt %) | | IP-391 |
| Saturates | 35.9 | |
| Mono-aromatics | 9.7 | |
| Diaromatics | 20.8 | |
| Poly-aromatics | 33.6 | |

Example 2

Figure 4:
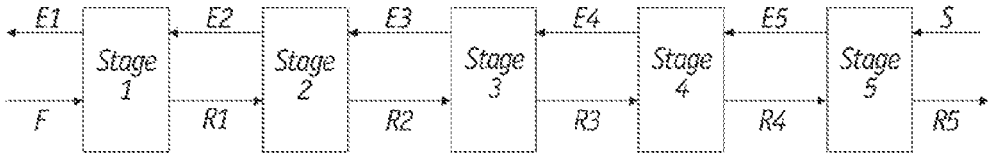
FIG. 4 is a schematic flow diagram of a laboratory 5-theoretical stage counter-current extraction scheme for producing RPO.

To demonstrate that environmentally qualified RPO can be produced from the feed mixture prepared in Example 1, the feed mixture was extracted in the laboratory with furfural. The Treybal experimental extraction method was used to precisely simulate a theoretical 5-stage counter-current extraction scheme, as shown in FIG. 4, in which feed (F) is introduced into stage 1 and exits as raffinate R5 at stage 5 while solvent (S) is introduced into stage 5 and exits as extract E1 at stage 1. For each extraction, the feed mixture and the furfural solvent were thoroughly mixed in a separatory funnel to create a raffinate phase and an extract phase, which were then separated after equilibrating for at least one hour at a predetermined temperature. The separated phases were contacted with fresh feed mixture, fresh furfural solvent, other raffinate phase or extract phase, according to the Treybal experimental scheme. For the theoretical 5-stage counter-current extraction process, the Treybal method required 28 extractions and phase separations through a network to achieve the final extraction results, which are summarized in Table 4.

TABLE 4

| | Temp (° C.) | S/O | Saturates | Mono-A | Di-A | Poly-A | PCA (IP-346) (wt %) | Yield (vol %) |
|---|---|---|---|---|---|---|---|---|
| | | | (Test method IP-391) (wt %) | | | | | |
| Feed Mixture | — | — | 35.9 | 9.7 | 20.8 | 33.6 | 15.30 | — |
| RPO-1 | 50 | 1.5 | 46.2 | 14.0 | 22.1 | 17.7 | 2.74 | 56.1 |
| RPO-2 | 60 | 1.5 | 47.5 | 14.7 | 21.6 | 16.3 | 1.89 | 48.9 |
| RPO-3 | 70 | 2.1 | 52.0 | 16.6 | 19.4 | 12.0 | 0.59 | 35.5 |
| Com. RPO* | — | — | 37.0 | 36.0 | 20.0 | 7.0 | 2.60 | — |

*Commercial RPO has aniline point of 68° C. and kinematic viscosity of 19.0 $mm^2/s$ @ 100° C.

Figure 5:
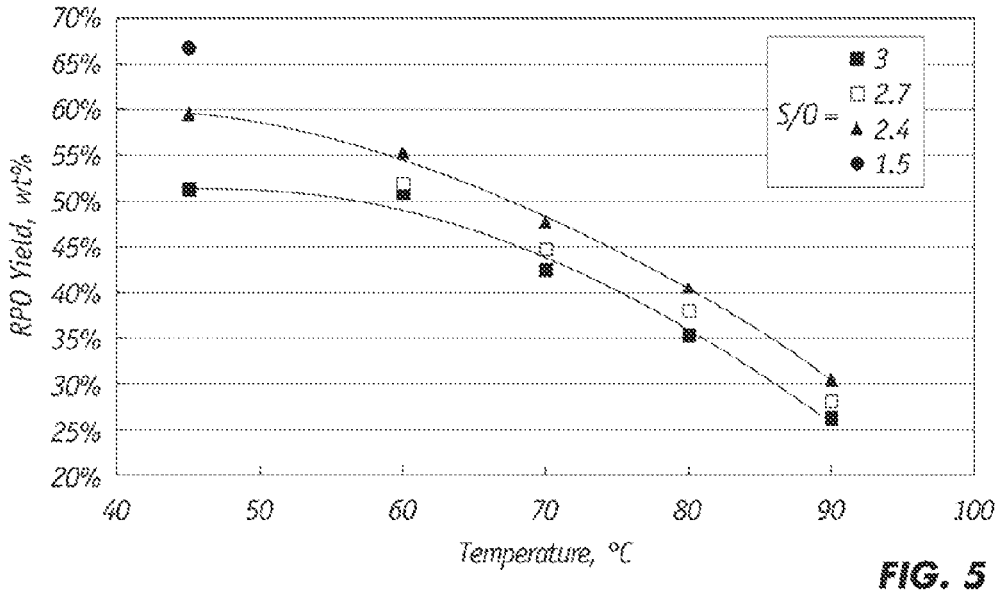
FIG. 5 shows the relationship of RPO yield versus the extraction temperature and solvent-to-oil ratio.
Figure 6:
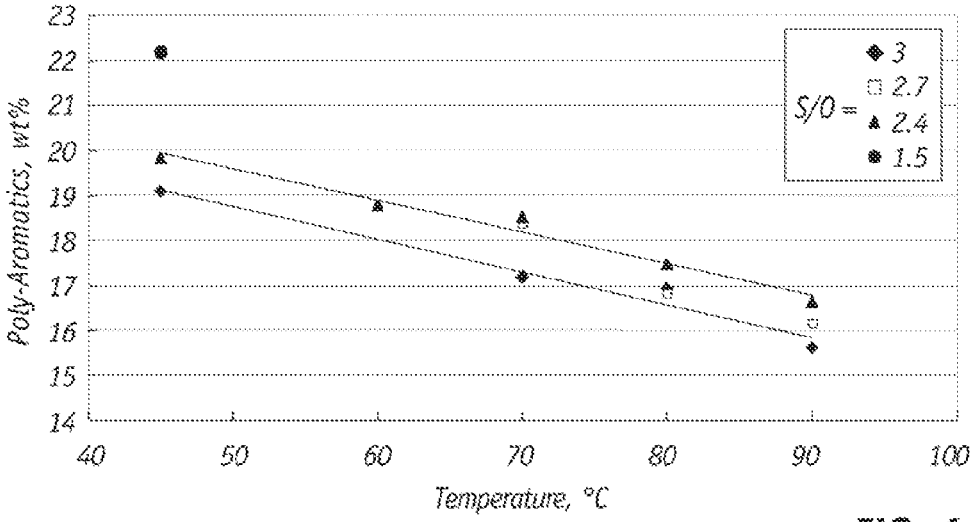
FIG. 6 shows the poly-aromatic (a part of total aromatic $T_A$)) content in the RPO versus the extraction temperature and solvent-to-oil ratio.

As shown in Table 4, RPO with less than 3 wt % of PCA was produced from a mixed feedstock containing 70% extract from the distillate boiling in lube base oil range and 30% extract from a DAO with 56.1% yield at 50° C. and S/O of 1.5. The PCA content in the RPO can be reduced as low as 0.59 wt %, but at much lower RPO yield of 35.5%. Since RPO is produced as the raffinate of this extraction, the yield of RPO was found to be inversely proportional to both the extraction temperature and the solvent-to-oil volume ratio (S/O). Experimental data of the RPO yield from a one-stage laboratory extraction at various solvent-to-oil ratios and temperatures is presented in FIG. 5. Poly-aromatics measured by test method IP-391 are closely related to PCA measured by test method IP-346. FIG. 6 indicates that the poly-aromatic content of the RPO produced from a one-stage laboratory extraction is also inversely proportional to both the extraction temperature and the solvent-to-oil volume ratio (S/O). Therefore, the PCA content as well as extraction yield of the RPO can be optimized by adjusting the temperature and S/O of the extraction operation.

Aniline point was not reported since the amount RPO generated from the laboratory extraction experiment was too small for the measurement. However, the aniline point is normally closely related to total aromatic (TA) content. Table 4 shows that the TA of RPO-1 is slightly lower than that of the commercial RPO (54 vs. 63 wt %), which is an indication that the aniline point of RPO-1 should be reasonably close to 80° C., since aniline point of the commercial RPO is only 68° C.

Example 3

To further demonstrate the effectiveness of the invention, test runs were conducted in a commercial extractor, with throughput capacity of 5,000 barrels per day, to simulate operation of the extraction column 105 in FIG. 1. In accordance with the process depicted in FIG. 1, the extract of the medium and heavy distillate oils from line 11 is mixed with the extract of DAO from line 13 under a volume ratio of approximately 70:30. Properties of the mixed extract in line 14 are summarized in Table 3 of Example 1.

In this demonstration, the mixed extract is fed via line 14 to the lower portion of the commercial extractor while in a blocked out operation whereby furfural solvent was introduced into an upper portion of the commercial extractor to counter-currently contact the mixed feed. The top temperature of the extractor was varied from 68 to 85° C., while the bottom temperature of the column was set at 50° C. The solvent-to-oil volume ratio for the extraction was in the range of 1.8 to 2.1. A raffinate stream was withdrawn from the top of extractor and then transferred to a solvent recovery column. Solvent was recovered from the top while the RPO product was recovered from the bottom of SRC. The properties of the RPO are presented in Table 5.

TABLE 5

| | Run No. 1 | Run No. 2 | Test Method |
|---|---|---|---|
| Extractor Operation | | | |
| Top temperature (° C.) | 85 | 68 | |
| Bottom temperature (° C.) | 50 | 50 | |
| Furfural-to-oil volume ratio | 2.1 | 1.8 | |
| Oil feed rate (M3/Hr) | 13 | 13.5 | |
| RPO (raffinate) yield (vol %) | 50 | 57 | |
| RPO Product Properties | | | |
| Aniline point (° C.) | 75.8 | 75.6 | D611 |
| K. viscosity ($mm^2/s$) @ 100° C. | 18.7 | 22.6 | D445 |
| PCA (wt %) | 1.93 | 1.69 | IP-346 |
| Density @ 15° C. | 0.943 | 0.951 | D4052 |
| Flash point (COC) (° C.) | 258 | 266 | D92 |
| Pour point (° C.) | 27 | 30 | D97 |
| Total Aromatics (TA) (wt %) | 56.5 | 61.2 | IP-391 |
| Mono-aromatics | 16.5 | 15.4 | |
| Di-aromatics | 23.8 | 26.5 | |
| Poly-aromatics | 16.2 | 19.3 | |
| Aromatic carbons (% $C_A$) | 22 | 24 | D-2140 |

From the commercial test run data, the RPO that is produced exhibited critical physical characteristics such as PCA, aniline point, kinematic viscosity, total aromatics (TA), and flash point that met or exceeded the new regulatory standards.

The foregoing has described the principles, preferred embodiment and modes of operation of the present invention. However, the invention should not be construed as limited to the particular embodiments discussed. Instead, the above-described embodiments should be regarded as illustrative rather than restrictive, and it should be appreciated that variations may be made in those embodiments by workers skilled in the art without departing from the scope of present invention as defined by the following claims.

What is claimed is:

1. A process for preparing a rubber processing oil (RPO), having a total aromatics content of more than 50 wt %, (or an aromatic carbon content of more than 20 wt %), a polycyclic aromatic content of less than 3 wt %, an aniline point. that is lower than 80° C., a kinematic viscosity from 15 to 30 $mm^2/s$ at 100° C., and a flash point that is higher than 250° C., which comprises the steps of:

(a) introducing a bottom stream from an atmospheric crude oil distillation column into a vacuum distillation column to yield (i) a light distillate oil stream, (ii) a medium distillate oil stream, (iii) a heavy distillate oil stream, and (vi) a vacuum residue stream, wherein the medium and heavy distillate oil streams are mixed to form a distillate mixture which has a boiling range from 390 to 620° C., with the proviso that the light distillate oil stream is not processed to prepare the RPO;

(b) producing a first aromatics-rich extract from the distillate mixture through counter current solvent extraction with a first polar extractive solvent in a first extraction column operating at a top temperature of 90-120° C., a bottom temperature of 70-90° C. and a solvent-to-distillate mixture volume ratio of 1 0-2.0 wherein the first aromatics-rich extract is a bottom stream from the first extraction column;

(c) producing a second aromatics-rich extract, from a deasphalted residual oil that is derived from the vacuum residue stream, through counter current solvent extraction with a second polar extractive solvent in a second extraction column operating at a top temperature of 100-140° C., a bottom temperature of 80-110° C. and a solvent-to-deasphalted residual oil (DAO) volume ratio of 2.0-4.0 wherein the second aromatics-rich extract is a bottom stream from the second extraction column;

(d) mixing the first aromatics-rich extract and the second aromatics-rich extract to yield a mixture that is subject to solvent extraction with a third polar extractive solvent to yield a raffinate phase wherein the mixture has a first aromatics-.rich extract to second aromatics-rich extract volume ratio in the range of 80:20 to 60:40; and (e) removing the third polar extractive solvent from the raffinate phase to yield the RPO.

2. The process of claim 1 wherein each of the first, second and third polar extractive solvent is selected from the group consisting of furfural, N-methyl pyrrolidone, diemthyl sulfoxide, propylene carbonate, and mixtures thereof.

3. The process of claim 1 wherein the first, second and third polar extractive solvents are the same and comprise furfural.

4. The process of claim 1 wherein each of steps (b), (c), (d) and (e) comprises solvent extraction that is conducted in a counter-current liquid-liquid extractor that is selected from the group consisting of a column with trays, a column with packings, a column with rotating discs, and a pulse column.

5. The process of claim 1 wherein step (d) comprises counter current solvent extraction in an extraction column operating at a top temperature of 60-90° C., a bottom temperature of 40-60° C. and a solvent-to-mixture volume ratio of 1.0-3.0.

6. The process of claim 1 wherein step (b) is conducted in a first extraction column and comprises collecting the first aromatics-rich extract and step (c) comprises collecting the second aromatics-rich extract and the process further comprises ceasing the production of the first aromatics-rich extract and of the second aromatics-rich extract and thereafter, mixing the collected first and second aromatics-rich extracts to yield a mixture that is subject to solvent extraction with a third polar extractive solvent in the first extraction column under conditions to yield a raffinate phase which forms the RPO when the third polar extractive solvent is removed from the raffinate phase.

7. .A process for preparing a rubber processing oil (RPO), having a total aromatics content of more than 50 wt %, (or an aromatic carbon content of more than 20 wt %), a polycyclic aromatic content of less than 3 wt %, an aniline point that is lower than 80° C., a kinematic viscosity from 15 to 30 $mm^2/s$ at 100° C., and a flash point, that is higher than 250° C., which comprises the steps of:

(a) introducing a bottom stream from an atmospheric crude oil distillation column into a vacuum distillation column to yield (i) a light distillate oil stream, (ii) a medium distillate oil stream, (iii) a heavy distillate oil stream, and a (vi) vacuum residue stream, wherein the medium and heavy distillate oil streams are mixed to form a distillate mixture which has a boiling range from 390 to 620° C., with the proviso that the light distillate oil stream is not processed to prepare the RPO;

(b) producing an aromatics-rich extract from the distillate mixture through counter current solvent extraction with a first polar extractive solvent in a first extraction column operating at a top temperature of 90-120° C., a bottom temperature of 70-90° C. and a solvent-to-distillate mixture volume ratio of 1.0-2.0, wherein the aromatics-rich extract is a bottom stream from the first extraction column;

(c) mixing the aromatics-rich extract with a deasphalted residual oil (DAO) that is derived from the vacuum residue stream to form a mixture that is subject to counter current solvent extraction with a second polar extractive solvent to form a raffinate phase in a second extraction column operating at a top temperature of 60-90° C., a bottom temperature of 40-60° C. and a solvent-to-mixture volume ratio of 1.0-3.0, wherein the mixture has an aromatics-rich extract to DAC) volume ratio in the range of 80:20 to 60:40; and (d) removing the second polar extractive solvent from the raffinate phase to yield the RPO.

8. The process of claim 7 wherein each of the first and second polar extractive solvent is selected from the group consisting of furfural, N-methyl pyrrolidone, diemthyl sulfoxide, propylene carbonate, and mixtures thereof.

9. The process of claim 7 wherein the first and second polar extractive solvents are the same and comprise furfural.

10. The process of claim 7 wherein each of steps (b) and (c) comprises solvent extraction that is conducted in a counter-current liquid-liquid extractor that is selected from the group consisting of a column with trays, a column with packings, a column with rotating discs, and a pulse column.

11. The process of claim 7 wherein step (b) is conducted in a first extraction column and comprises collecting the first aromatics-rich extract and the process further comprises collecting the DAO and thereafter ceasing the production of the first aromatics-rich extract and of the DAO and then, mixing the collected first aromatics-rich extract and the DAO to yield a mixture that is subject to solvent extraction with the second polar extractive solvent in the first extraction column under conditions to yield a raffinate phase from which the RPO forms when the second polar extractive solvent is removed from the raffinate phase.

* * * * *